US009714120B2

(12) United States Patent
Fuchs

(10) Patent No.: US 9,714,120 B2
(45) Date of Patent: Jul. 25, 2017

(54) DEVICE FOR DOSING CREAMS

(71) Applicant: F + K Innovationen Unternehmergesellschaft (haftungsbeschraenkt), Baden-Baden (DE)

(72) Inventor: Karl-Heinz Fuchs, Radolfzell (DE)

(73) Assignee: F + K Innovationen Unternehmergesellschaft (haftungsbeschraenkt), Baden-Baden (DE)

( * ) Notice: Subject to any disclaimer, the term of this patent is extended or adjusted under 35 U.S.C. 154(b) by 12 days.

(21) Appl. No.: 14/440,780

(22) PCT Filed: Nov. 7, 2013

(86) PCT No.: PCT/EP2013/073286
§ 371 (c)(1),
(2) Date: May 5, 2015

(87) PCT Pub. No.: WO2014/072418
PCT Pub. Date: May 15, 2014

(65) Prior Publication Data

US 2015/0329246 A1 Nov. 19, 2015

(30) Foreign Application Priority Data

Nov. 7, 2012 (DE) ..... 10 2012 110 671
Nov. 7, 2013 (DE) ..... 10 2013 112 280

(51) Int. Cl.
*B65D 35/00* (2006.01)
*B65D 37/00* (2006.01)
*B65D 35/40* (2006.01)

(52) U.S. Cl.
CPC ..... *B65D 35/40* (2013.01)

(58) Field of Classification Search
CPC ..... B65D 35/40
USPC ..... 222/92, 367, 368, 444, 450, 452
See application file for complete search history.

(56) References Cited

U.S. PATENT DOCUMENTS

| | | | | |
|---|---|---|---|---|
| 1,975,154 A * | 10/1934 | Jordan | B65D 35/40 222/219 |
| 2,076,720 A | 4/1937 | Haggerty | |
| 2,200,117 A * | 5/1940 | Milbank | B65D 35/40 222/322 |
| 5,636,765 A | 6/1997 | DeJonge | |
| 2005/0121472 A1 * | 6/2005 | Wessels | B65D 35/40 222/362 |

FOREIGN PATENT DOCUMENTS

| | | |
|---|---|---|
| DE | 681256 C | 9/1939 |
| WO | 2004092032 A1 | 10/2004 |

* cited by examiner

*Primary Examiner* — Patrick M Buechner
*Assistant Examiner* — Jeremy W Carroll
(74) *Attorney, Agent, or Firm* — Bachman & LaPointe, PC

(57) ABSTRACT

A device for dosing from a tube (2) for creams or gel-like products, wherein a dosing wheel (1) is provided.

2 Claims, 6 Drawing Sheets

DEVICE FOR DOSING CREAMS

BACKGROUND OF THE INVENTION

It is known from the prior art that dosing from a tube may be performed by varying the diameter of the outlet opening. Apart therefrom dosing takes place by the squeezing pressure which is applied to the tube.

The known tube closures close the tube but have no possibility for dosing the strand which is to be deployed by squeezing the tube, that is to say for dosing said strand to a desired determined deployment length; therefore, the measures in package inserts of pharmaceuticals are always indicated as, for example, 2 cm, 4 cm, or pea-size, walnut-size.

Human visual judgment and sense can be deceived, such that the user is unable to squeeze the exact guaranteed desired dosing amount from the tube.

The novel idea is to provide dosing of a cream-type and gel-type medium from a tube, that is to say to provide a dosing aid. The known handling of deployment, squeezing, and compression of the tube are to be conjointly integrated.

SUMMARY OF THE INVENTION

The object is achieved by the dosing device of the present invention.

The novel idea is to always provide the user, handler with the firmly set desired dosing amount, strand length, against the background of providing the consumer with the same handling as in the case of the known tube.

For the pharmaceutical manufacturer this idea is likewise intended to contribute toward safety, since unintentional underdosing or overdosing, respectively, is no longer possible.

In order to apply different doses or strand lengths, respectively, the system is offered to the industry having various dosing-wheel diameters or having a variably sized dosing space, respectively.

A device according to the invention serves for deploying creams or gel-type products in a dosed manner. These products may be pharmaceuticals, cosmetics, adhesives, silicone, or any other gel-type or cream-type product. The gel-type or cream-type products preferably are provided as the tube content in a tube. The tube per se here may be of plastic or metal. The term tube here is to be understood as any container which is suitable for receiving the abovementioned products.

The device according to the invention represents a strand-dosing unit which is attachable to the tube so that the outlet of the tube communicates with the dosing chamber of the dosing unit. Attachable here means that the strand-dosing unit may be screwed, clamped, clinched or otherwise attached to the tube. Attachable also includes that the strand-dosing unit may also be removed again from the tube in a tool-less manner.

The strand dosing unit according to the invention comprises a dosing wheel. This means that the dosing wheel is attached to the strand dosing unit. In detail, this means that the dosing wheel is received by the strand dosing unit. The dosing wheel is rotatably disposed on or in the strand dosing unit.

The dosing wheel has a dosing chamber. The size, extent, volumetric capacity, or the surface properties of the dosing chamber are adaptable to the products to be deployed. Preferably, the dosing chamber is configured so as to be cylindrical. The dosing chamber interacts with a ball piston.

This means, for example, that a product which is pressed into the dosing chamber the ball piston in the direction of an exit opening. The dosing wheel is subsequently rotated by 180°. In this state the ball piston is again in the region of the deployment point of the product from the tube. If the tube is now manipulated, further product is pressed into the dosing chamber and pushes the ball piston farther in the direction of the exit opening, thereby pushing the product which has initially been introduced out of the exit opening. The manner in which the tube is manipulated is irrelevant to the invention which only requires that the tube be adapted to compress the product to force same through the tube outlet and into the dosing chamber.

The dosing wheel is composed of two half-shells. This has the advantage that the dosing wheel can be manufactured in a comparatively simple fashion.

In another exemplary embodiment the strand dosing unit has a check valve which prevents that by way of a relaxation of tubes made of plastic and of flexible tubes, re-entry of the product into the tube is to be prevented.

The check valve comprises a sealing collar, wherein the check valve is spring loaded in relation to the sealing collar. This leads to improved functional capability and to simplified attachability of the check valve.

A strand dosing unit according to the invention furthermore comprises a protective cap. Apart therefrom, a concave finger receptacle is provided on the dosing wheel. This leads to simplified handling of the dosing wheel.

BRIEF DESCRIPTION OF THE DRAWINGS

Further advantages, features, and detail are derived from the following description of preferred exemplary embodiments.

DETAILED DESCRIPTION

Figure 1:
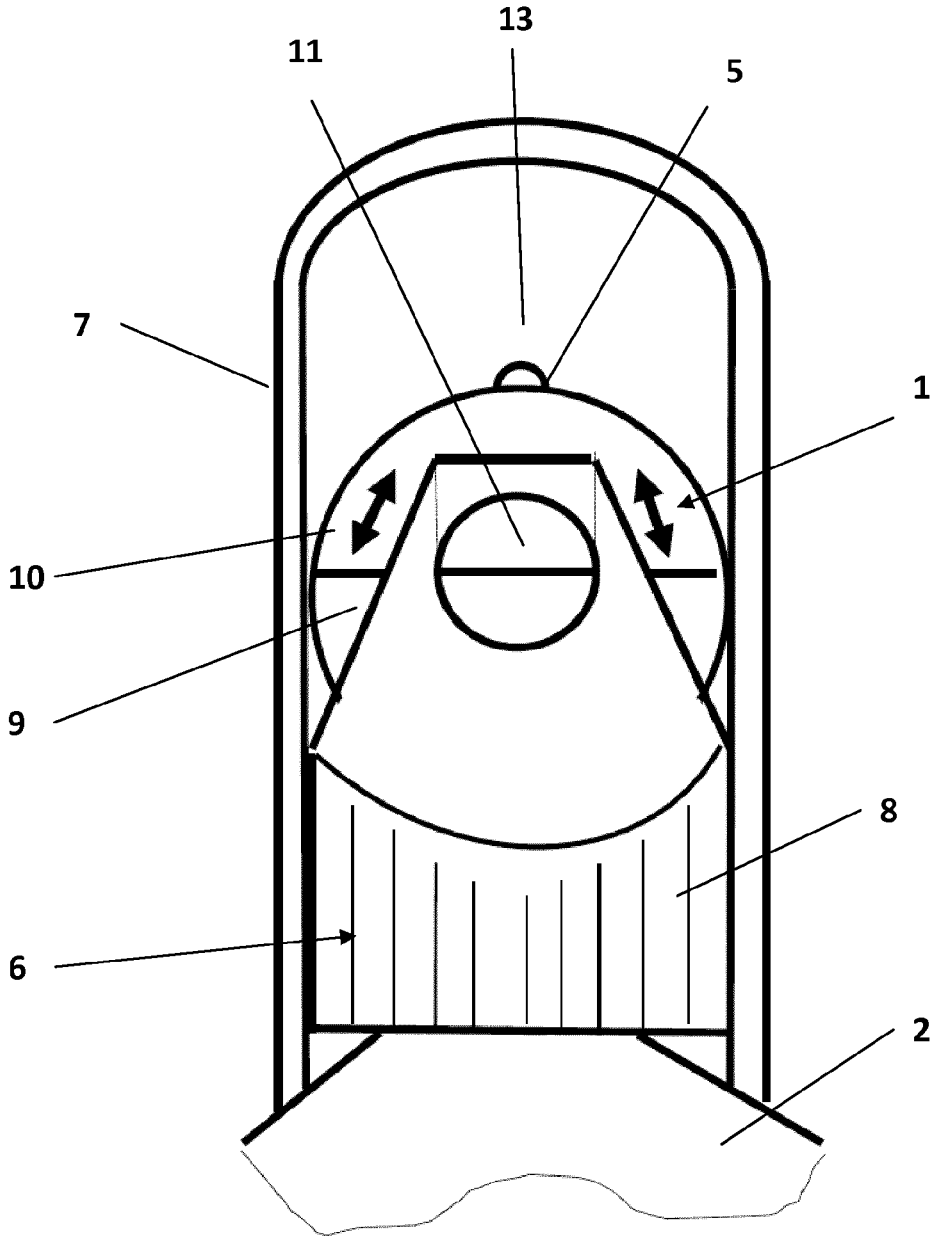
FIG. 1 illustrates a first embodiment of the dosing unit attached to a tube.

The tube 2 is opened by turning the dosing wheel 1 by 180°, and the tube content 3 may by the known squeezing handling of the tube 2, that is to say by compressing and squeezing the tube wall 4, on account of which the tube content 3 can be removed by way of the exit opening 5.

In FIG. 1 the strand dosing unit 6 is screwed onto the tube 2 and protected against contamination and uncontrolled activation by a protective cap 7.

Two half-shells 9 and 10 are anchored in a threaded housing 8 by way of the split axle receptacle 11. The two half-shells 9 and 10 substantially form the dosing wheel 8.

The strand dosing unit 6 is opened by rotating the dosing wheel 1, such that by squeezing the tube 2 the product to be deployed can be removed from the deployment opening 5 and can simultaneously again flow from the tube 2 into the dosing space 12.

Figure 2:
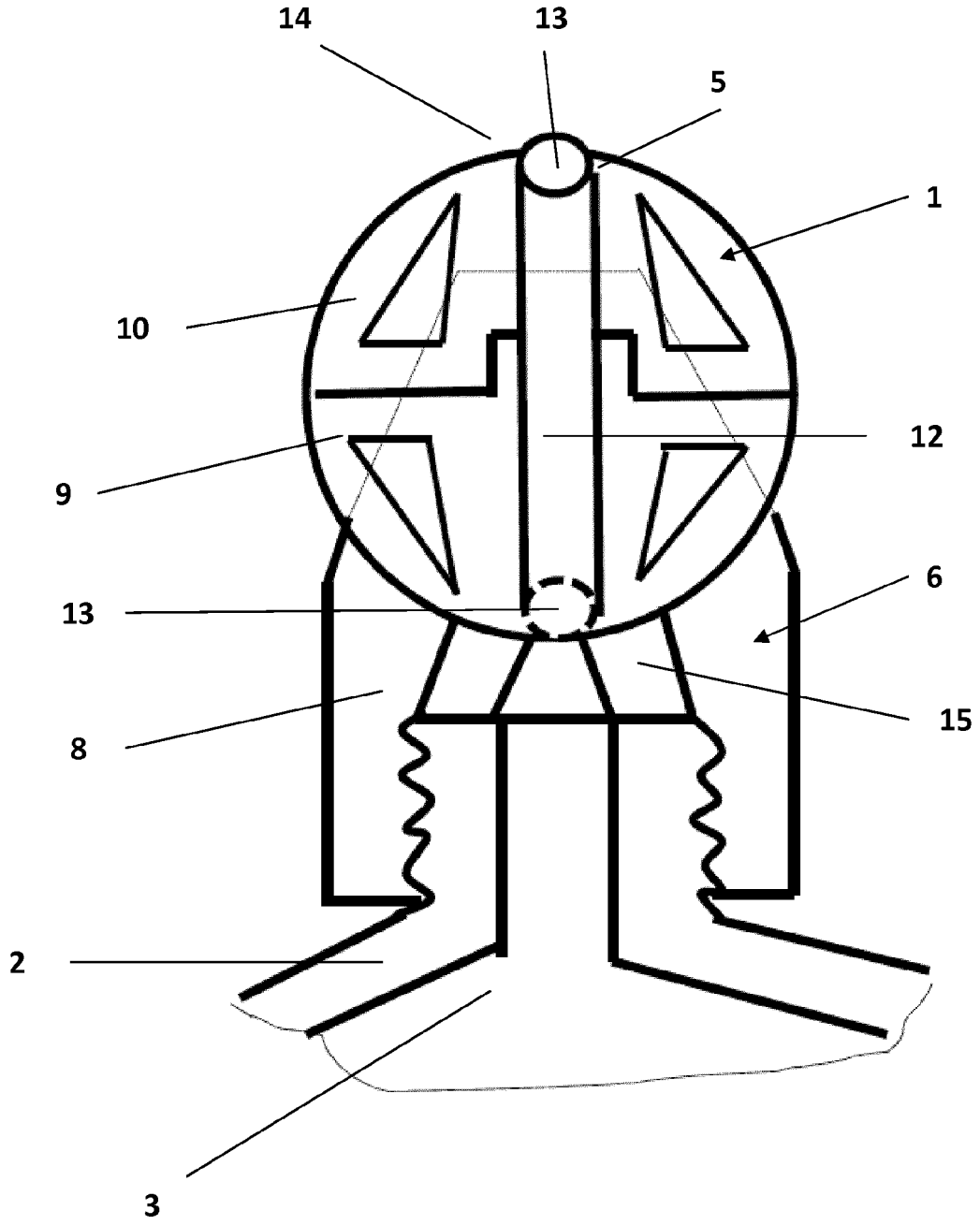
FIG. 2 is a sectional view of the dosing unit and tube of FIG. 1.

FIG. 2 shows a section through the strand dosing unit 6, having the dosing wheel 1 which is composed of two half-shells 10 and 9. Product dosing is performed by way of the centric dosing chamber 12 having the ball piston 13.

Figure 3:
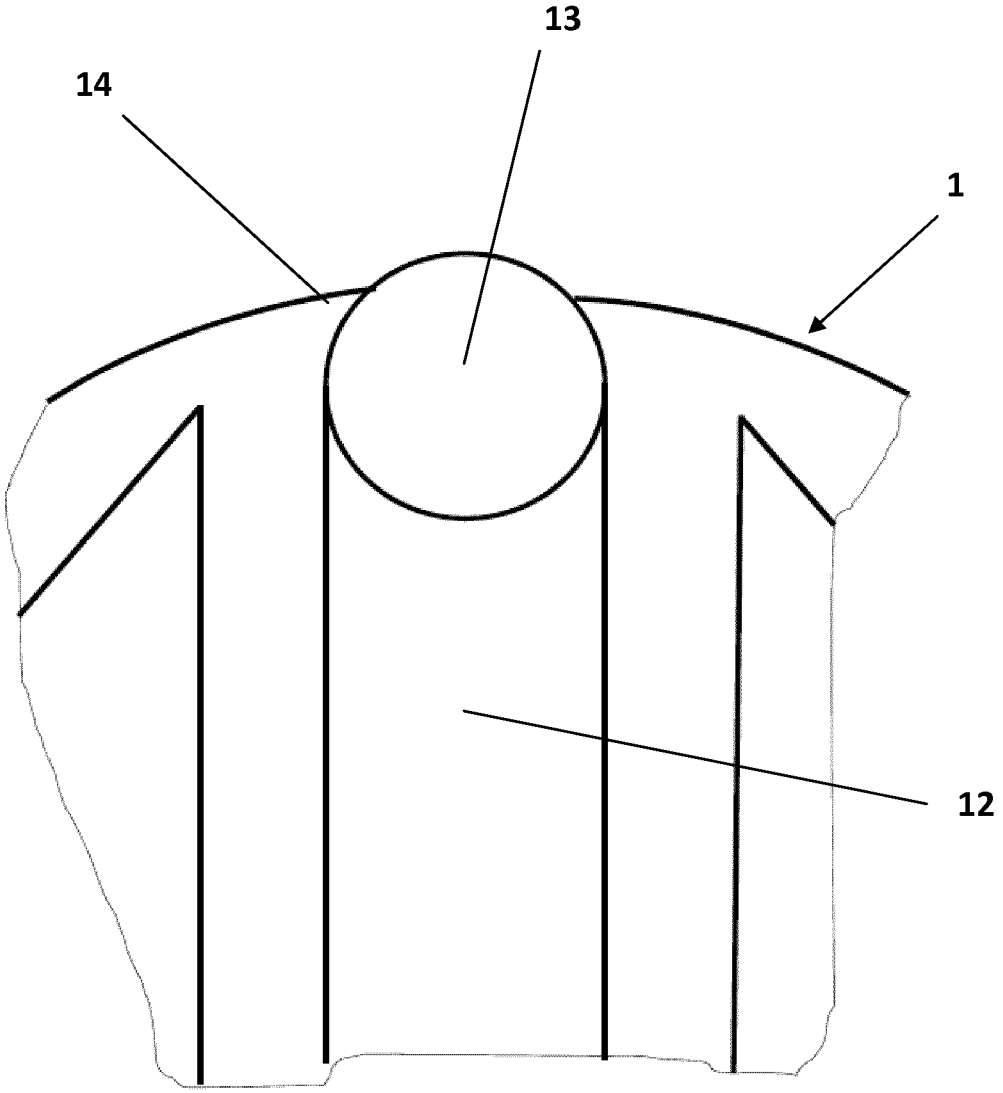
FIG. 3 is an exploded partial view showing the sealing seat formed by the dosing chamber for the ball piston.

FIGS. 2 and 3 shows the system in the closed position, with the ball piston 13 lying in the sealing seat 14, and the filled dosing chamber 12.

By way of rotation of the dosing wheel 1 by 180° the ball piston 13 by way of the sealing collar 15 is brought to latch, such that on account of squeezing the tube 2, the tube content 3, together with the ball piston 13, covers the defined path in the dosing space 12 and, on account thereof, by way of the filled dosing space 12 the medium flows as a strand of cream through the deployment opening and may be removed.

In the closed position (see FIG. 2) the ball piston 13, lying in the sealing seat 14, closes off the system.

By rotating the dosing wheel 1 the ball piston 13 is always alternatingly moved through the product which is squeezed out of the tube 2 and via the fixed dosing path and the desired strand length to the deployment opening.

The sealing collar 15 sits in the housing 8 and between the tube 2 and the dosing wheel 1 seals the medium which is squeezed out of the tube 2 in relation to the transition into the dosing space 12.

Figure 4:
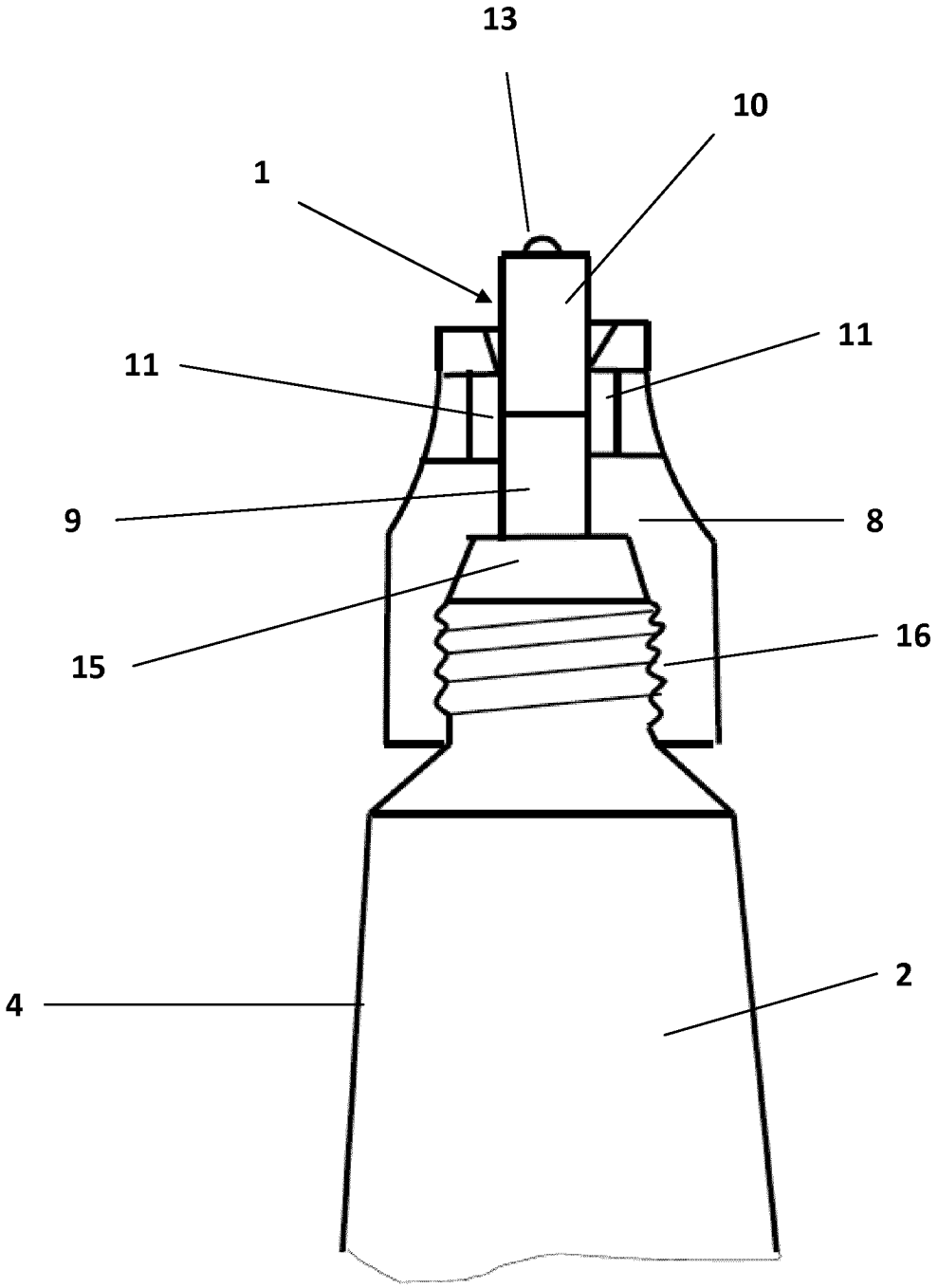
FIG. 4 illustrates the details of the dosing wheel having the dosing chamber.

The anchoring of the dosing wheel 1, which is composed of two half shells 10 and 9 in the housing 8 by way of the split axle receptacle 11, is illustrated in FIG. 4.

The sealing collar 15 bears on the planar face of the tube thread 16.

Figure 5:
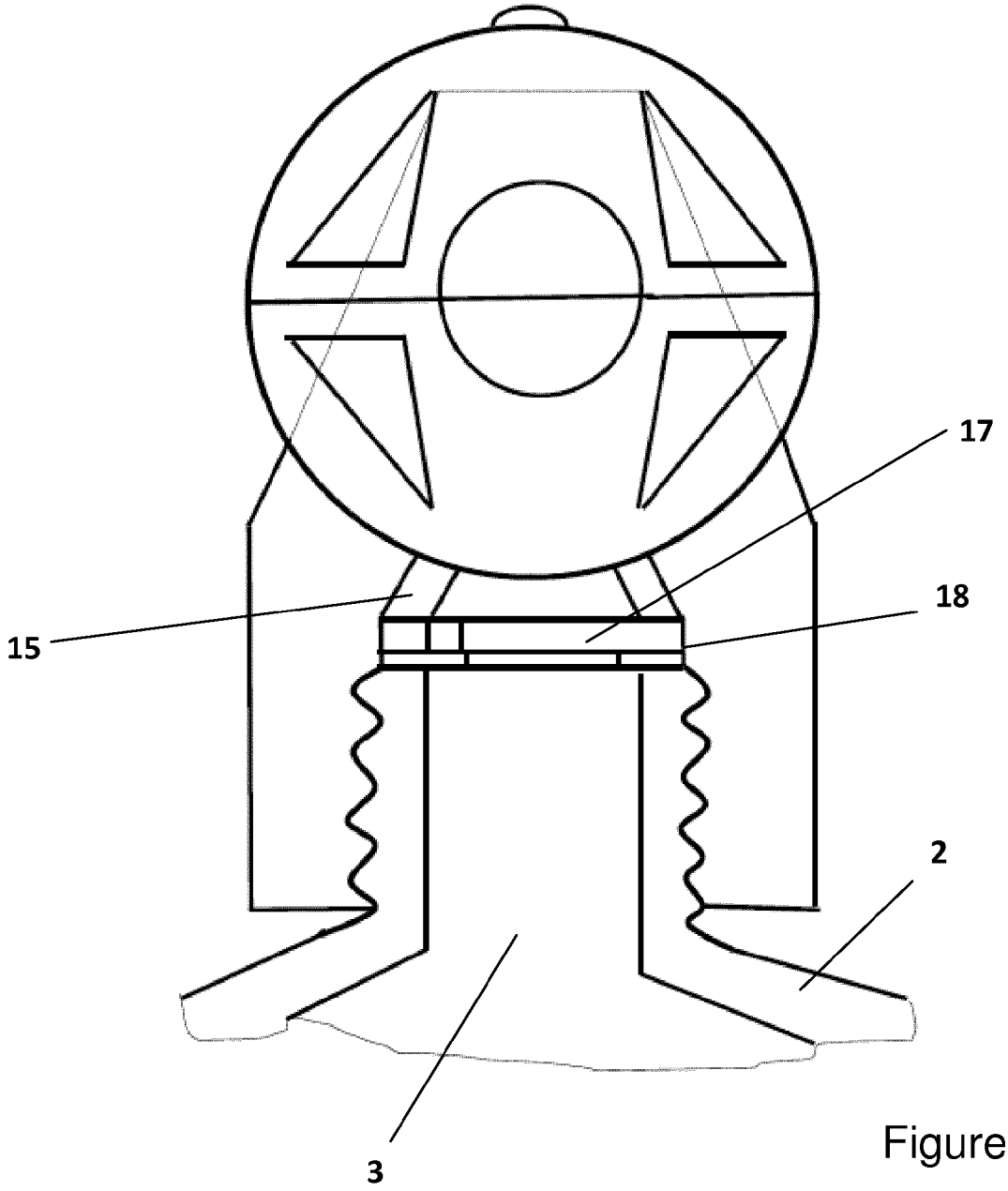
FIG. 5 shows a second embodiment which includes a check valve.

FIG. 5 shows a variant having a check valve 17 toward the tube 2, wherein a soft seal 18 as a bearing for the check valve 17, which is configured as a plate valve, is integrated directly on the planar face of the thread.

The sealing collar 15 is integrated above the check valve 17 toward the dosing wheel 1.

The check valve 17 is to be employed for plastic tubes in order to stop the reverse suction force which is triggered by the plastic tube walls.

There is no reverse suction force in the case of sheet-metal tubes, since the sheet-metal tube wall remains in the deformed state and does not try to revert to its initial position on account of the inherent material tension, as is the case with a plastic tube.

By way of this idea a safe dosing possibility and dosing aid for tubes is being offered to the pharmaceutical and cosmetics market.

This novel system may also be deployed in all industries, such as, for example, adhesives, silicones, greases, etc.

By way of the employment of various dosing wheel diameters or dosing space sizes, respectively, all dosing volumes are covered by the variants of the system. Furthermore, on account of the variably sized dosing spaces and of different materials in the dosing region, all creams and gel-type products can be catered for.

Figure 6:
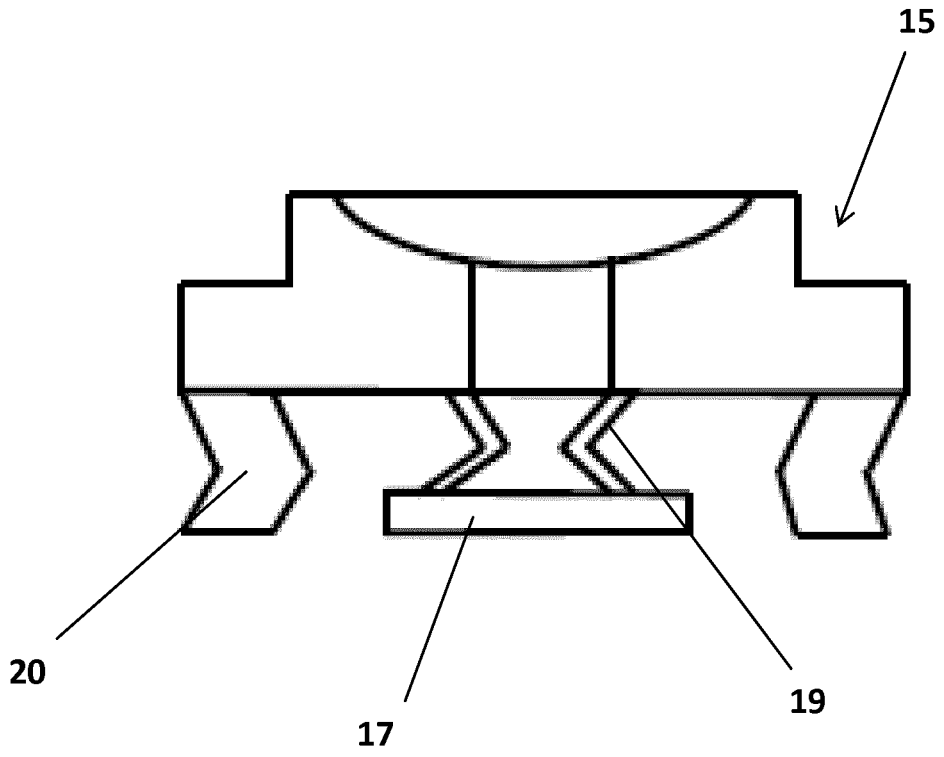
FIG. 6 is an exploded view of the check valve of FIG. 5.

FIG. 6 shows a variant of the sealing collar 15 having a spring-loaded check valve 17. The check valve 17 is configured such that it includes a spring element 19 for closing the spring collar 15, and a compression-spring element 20 in order to control the contact pressure on the half shells 9 and 10 for tight functioning.

The strand dosing unit 6 has a concave finger receptacle for activating the dosing wheel 1.

The invention claimed is:

1. A dosing unit for dosing a desired dosing amount of product from a tube, comprising:

a tube containing a product to be dosed, the tube having an outlet; and a dosing unit attached to the tube at the tube outlet, the dosing unit comprising a rotatable body having a dosing chamber sized to the desired dosing amount, the dosing chamber communicates with the tube outlet for moving product from the tube when the tube is manipulated, a movable ball piston in the dosing chamber which is movable between a first end of the dosing chamber and a second end of the dosing chamber, wherein the rotatable body is adapted to selectively rotate to alternately bring the first and second ends into communication with the tube outlet, wherein the rotatable body comprises two half-shells, and further comprising a non-return valve for closing the outlet of the tube, a sealing collar for sealing against the two half-shells, a spring element biasing the non-return valve relative to the sealing collar toward the outlet of the tube, and a compression spring element which biases the sealing collar toward the two half-shells for contact and tight operation between the sealing collar and the two half-shells.

2. A dosing unit for dosing a desired dosing amount of product from a tube, comprising:

a tube containing a product to be dosed, the tube having an outlet; and a dosing unit attached to the tube at the tube outlet, the dosing unit comprising a rotatable body having a dosing chamber sized to the desired dosing amount, the dosing chamber communicates with the tube outlet for moving product from the tube when the tube is manipulated, a movable ball piston in the dosing chamber which is movable between a first end of the dosing chamber and a second end of the dosing chamber, wherein the rotatable body is adapted to selectively rotate to alternately bring the first and second ends into communication with the tube outlet, wherein the rotatable body comprises two half-shells, and wherein the half-shells together define a split axle which is received in a threaded housing of the dosing unit to rotatably hold the half-shells relative to the threaded housing, and wherein the threaded housing attaches to the tube to hold the dosing unit to the tube.

* * * * *